United States Patent [19]

Bennett et al.

[11] 4,241,854

[45] Dec. 30, 1980

[54] LIQUID DISPENSER

[75] Inventors: Robert A. Bennett, 170 Sturbridge Rd., Easton, Conn. 06425; Owen Van Brocklin, Bristol, Conn.

[73] Assignee: Robert A. Bennett, Easton, Conn.

[21] Appl. No.: 97,733

[22] Filed: Nov. 26, 1979

[51] Int. Cl.[3] ..... B65D 37/00

[52] U.S. Cl. ..... 222/207; 222/211; 222/212

[58] Field of Search ..... 222/207, 211, 215, 212, 222/581, 209, 210; 401/8, 11

[56] References Cited

U.S. PATENT DOCUMENTS

| | | | |
|---|---|---|---|
| 2,078,862 | 4/1937 | Llewellyn | 222/581 |
| 2,752,069 | 6/1956 | Welsh | 222/207 |
| 2,979,236 | 4/1961 | Fahr | 222/490 X |
| 4,122,980 | 10/1978 | Laverty | 222/207 |
| 4,190,180 | 2/1980 | Bennett | 222/207 |

*Primary Examiner*—Allen N. Knowles

[57] ABSTRACT

A horizontal diaphragm with a central recess has a downwardly extending peripheral lip engaging the periphery of an open neck of a container of fluid. A vertical hollow tubular element in the neck has an upper section disposed below the diaphragm and engaging the neck periphery. The section wall defines an inverted truncated cone with spaced longitudinally extending slots. A lower section has an upper opening coincident with the lower cone end and a lower opening extending into the container below the liquid level. A vertical bore in the element has a first constriction which passes liquid disposed in the lower section. The bore wall contains a vertical cylindrical recess communicating at its top end with the cone interior. A vertical tube extends through a central hole in the diaphragm. The tube is slidable in said recess and has a second constriction interiorly disposed intermediate its ends. The tube interior is connected by conduits to the concave recess. A vertical prong in the bore and tube is secured at its bottom end in the first constriction without obstructing liquid passage. The top end of the prong is disposed above and is larger than the second constriction. The main prong body slides through said second constriction with clearance to permit liquid to flow around said body through said second constriction.

6 Claims, 5 Drawing Figures

FIG. 1
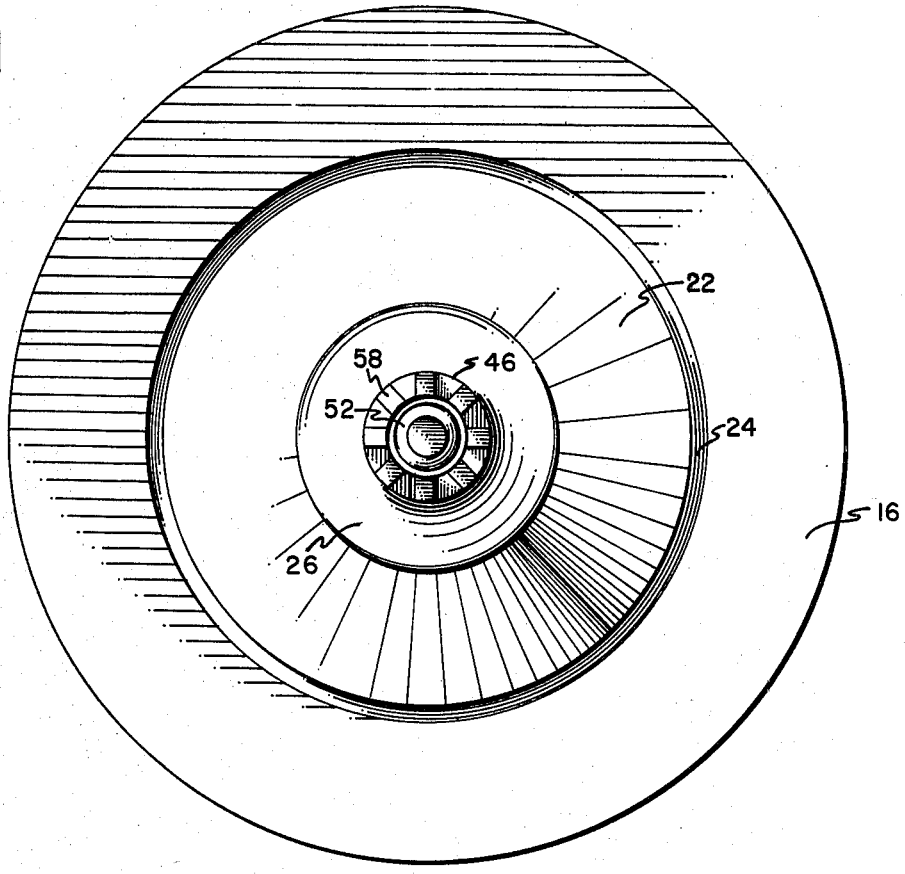
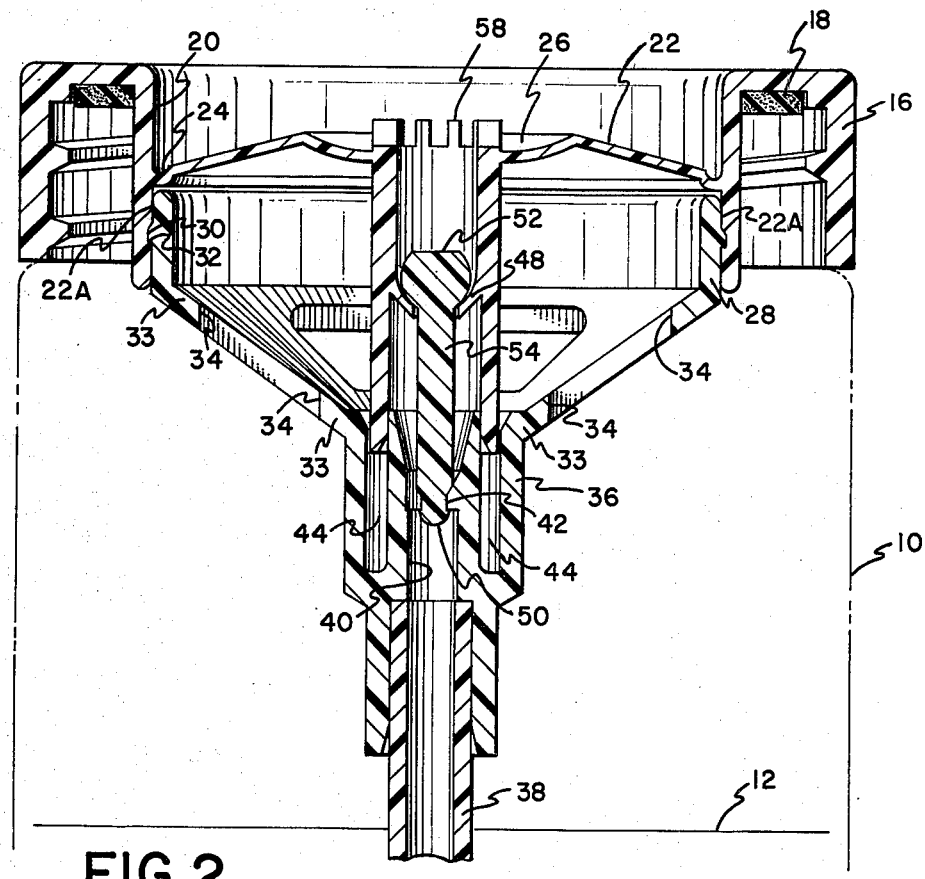
FIG. 2

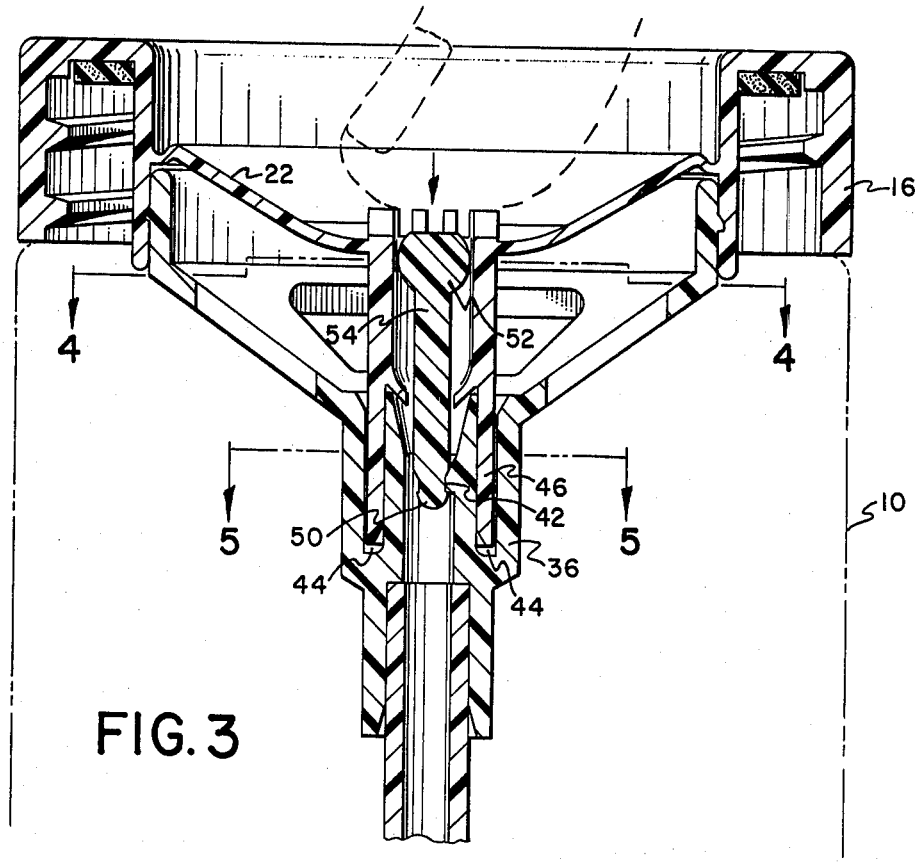
FIG. 3
FIG. 4
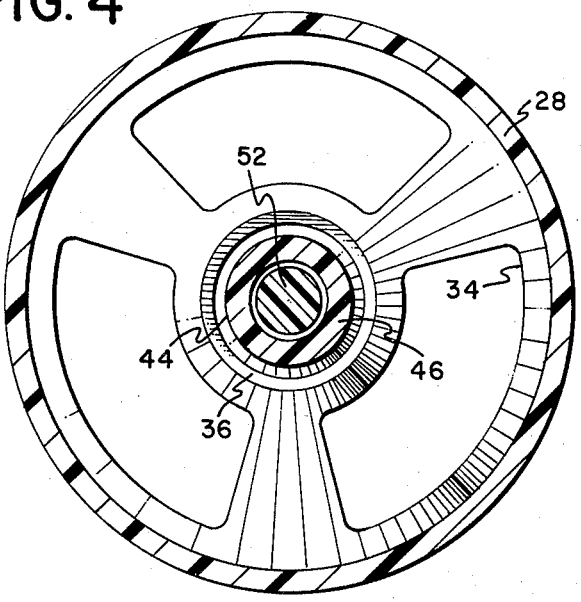
FIG. 5
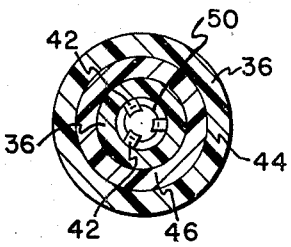

LIQUID DISPENSER

CROSS REFERENCE TO CO-PENDING APPLICATION

In the co-pending United States patent application entitled "Liquid Dispenser" filed in the name of the inventor Robert A. Bennett on Dec. 20, 1978, Ser. No. 971384, now U.S. Pat. No. 4,190,180 (the same Robert Bennett being a co-inventor and the assignee of the entire interest in the present application) there is disclosed a device which enables a user to dispense a metered amount of liquid sufficient to remove all the polish from a nail and insufficient to produce discoloration or cracking of the nail while at the same time minimizing the exposure to air of the liquid remover remaining in the container. This device is a dispenser for use with a container of liquid having a vertical neck open at the top. The dispenser comprises a horizontal flexible diaphragm having a downwardly extending peripheral lip adapted for detachable sealing engagement with the periphery of the open neck whereby the diaphragm covers the top of the neck. The diaphragm has a top disposed concave cup-like recess centrally disposed therein and inwardly spaced from said lip. The recess has a central hole at the bottom thereof.

A vertically elongated tubular element extends through said hole and is sealed thereto. The element has an open top end disposed above said hole in the recess, an open bottom end adapted to extend into said container below the level of said liquid, and a vertical bore interconnecting said top and bottom open ends. The bore has a vertically elongated enlarged region with a top and a bottom, said region being disposed intermediate the top and bottom ends of the element. The top end of the element has a plurality of horizontal spaced conduits interconnecting the bore with the interior of the recess.

A member is disposed in said region and is slidable up and down therein, said member being moved by gravity to the bottom of the region when the element is upright and being moved by gravity to the top of the region when the element is inverted.

First and second sealing means cooperate with said member and are disposed in the region adjacent the top and bottom thereof respectively, said member when disposed in the top of region engaging the first means and when disposed in the bottom of the region engaging the second means, each means when engaged by said member forming a closed check valve through which said liquid cannot pass.

Typically, said member is a sphere, said region is a vertical cylinder, said bore in horizontal cross section is circular in shape, and said diaphragm and said neck are circular in shape. Moreover the conduits extend radially outward through the top end of said element.

That portion of the diaphragm intermediate the top of the recess and the inner part of the lip extends radially outward and downwardly from the recess to the lip when the diaphragm is not flexed. The diaphragm portion, when manually flexed, extending radially outward and upward from the recess to said lip. The diaphragm returns automatically from flexed to unflexed position when the manual flexing action ceases. The diaphragm during its flexure produces a suction force which, when the dispenser is in position in the container and the container is upright, opens the closed check valve and causes liquid to be drawn upward in the element and discharged via the top end of the element and said conduits into said recess.

In use, a cotton ball or the like is held covering the top end of the element and is pushed downward into the recess to flex the diaphragm. The liquid which typically is, but need not be, nail polish remover is then discharged into the ball and is absorbed therein for subsequent application and use. The same metered amount of liquid is discharged each time flexure occurs. When the downward pressure is released, the diaphragm returns automatically to the unflexed position.

The sphere normally engages the second sealing means and prevents air from entering the container. During flexure, the suction force momentarily lifts the sphere up whereby the liquid is discharged. Then the sphere falls downward by gravity and only sufficient air is introduced into the container via the channels and space between the second means and the descending sphere to replace the volume of liquid discharged before the sphere again engages the second means. Thus the amount of air introduced into the container during each dispensing action is minimized.

BACKGROUND OF THE INVENTION

When the dispenser described above is stored in a heated area for an appreciable period or is held in a user's hand for a similar period, air in the dispenser is heated and expands. If the expansion action is sufficiently energetic, the sphere can be forced upward momentarily and liquid can be discharged even though the diaphragm has not been flexed. This accidental discharge impairs the usefulness of the dispenser for some applications. The present invention employs a different dispenser construction which eliminates accidental discharge.

SUMMARY OF THE INVENTION

A liquid dispenser in accordance with the principles of this invention is inserted into a container of liquid having a vertical neck open at the top. The dispenser employs a horizontal flexible diaphragm having a downwardly extending peripheral lip adapted for detachable sealing engagement with the periphery of the open neck whereby the diaphragm covers the top of the neck, said diaphragm having a top disposed concave cup-like recess centrally disposed therein with a central hole at the bottom thereof and inwardly spaced from the lip.

A vertically elongated hollow tubular element having an outwardly flared upper section is disposed adjacent but spaced below the diaphragm and is adapted for detachable sealing engagement with the peripheral lip. The section has a side wall which defines an inverted truncated cone with spaced longitudinally extending slots therein. The element also has a lower vertical hollow section with an upper opening coincident with the lower end of said cone and a lower opening adapted to extend into the container below the level of the liquid, the element having a vertical bore extending therethrough. The bore has a first constriction which permits the passage of liquid therethrough and which is disposed in the lower section adjacent but below the upper opening thereof. The bore wall contains a vertical recess which is spaced outwardly from the interior of the bore and is spaced inwardly from the outer surface of the lower element. The vertical recess communicates at its upper end with the interior of the cone and has a closed bottom end disposed below the first constriction.

A vertically elongated hollow tube is sealed to and extends through the central hole in the diaphragm. An open top end of the tube is disposed above this hole and an open bottom end is always disposed in the vertical recess. This top open end has a plurality of horizontally spaced conduits interconnecting the interior of the tube with the interior of the concave recess. The tube is vertically slidable in the vertical recess. The hollow interior of the tube is provided with a second constriction disposed intermediate the ends of the tube.

A vertical prong is disposed in the bore and in the tube interior. The bottom end of the prong is secured in the first constriction in such manner as not to obstruct the passage of liquid therethrough. The top end of the prong, which is larger than and cannot pass through the second constriction is disposed above the second constriction. The main body of the prong is slidable through the second constriction with sufficient clearance to permit liquid to flow around the body and through the second constriction.

Normally, the diaphragm is in its normal unflexed position. The tube is in its normal raised position. At this point, the second constriction bears upward against the upper enlarged end of the prong in sealing engagement and defining a closed valve through which liquid cannot pass. In contradistinction to the dispenser disclosed in the aforesaid co-pending application, any expansion action caused by heated air will only increase the pressure holding the valve closed whereby accidental discharge cannot occur.

However, when the diaphragm is flexed, the tube is pushed downward and slides vertically downward in the vertical recess. The prong remains motionless, so the tube movement lowers the second constriction, moving it out of sealing engagement with the upper end of the tube. The valve is opened and liquid is discharged via the top end of the tube and its conduits into the concave recess. Thus the dispenser disclosed in the present application can be used in the same manner as the dispenser disclosed in the aforesaid co-pending application.

BRIEF DESCRIPTION OF THE DRAWINGS

FIG. 1 is a top view of a liquid dispenser in accordance with the invention.

FIG. 2 is a vertical cross sectional view of the dispenser of FIG. 1 showing the upper end of the prong in sealing engagement with the second constriction and the diaphragm in normal unflexed position.

FIG. 3 is a view similar to FIG. 2 but showing the upper end of the prong out of sealing engagement with the second constriction and the diaphragm in momentary flexed position.

FIG. 4 is a cross sectional view taken along line 4—4 in FIG. 3.

FIG. 5 is a corss sectional view taken along line 5—5 in FIG. 3.

DETAILED DESCRIPTION OF PREFERRED EMBODIMENT

Referring now to FIGS. 1–5, a container 10 with nail polish remover 12 therein has an open neck. A screw cap 16 with a top disposed inner seal 18 covers the neck and has an inner portion 20 which extends tightly along the inside of the neck. A circular diaphragm 22 is peripherally secured to the inner portion 20 with the section of portion 20, shown at 22A constituting a downwardly extending peripherally disposed circular lip. As will be explained below, section 22A forms a liquid tight seal with the inner surface of the neck. A circular groove 24 in the top surface of the diaphragm disposed adjacent the lip permits the diaphragm to be flexed and automatically return to original unflexed position without disturbing the seal between the lip and the neck. The diaphragm has a centrally disposed top concave recess 26 upwardly spaced from the groove and having a central hole in the bottom thereof.

An outwardly flared upper section 28 of a vertically elongated hollow tubular element is deposed adjacent but below the diaphragm with circular rib 30 engaging inner circular recess 32 in section 22A to form the liquid seal described above. The side wall 33 of element 28 has elongated longitudinally extending slots or openings 34 therein and defines an inverted truncated cone. This element has a lower vertical hollow section 36 with an upper end coincident (and integral) with the lower end of the cone and a lower opening extends below the level of the liquid, being extended if necessary by removable dip tube 38. A vertical bore 40 extends through the entire element and contains a first constriction (see FIG. 5) defined by spaced vertical ribs 42 which extend radially inward but do not reach the center of the bore. The bore wall contains a vertical cylindrical recess 44 (spaced outwardly from the interior of the bore and spaced inwardly from the outer surface of the lower section.

A vertical cylindrical hollow tube 46 extends upwardly through the central hole and is integral therewith. Tube 46 has a top open circular end disposed in the recess above the hole with a plurality of horizontally disposed radial channels 58 disposed in the top end and interconnecting the hollow interior of tube 24 with the interior of the recess. The bottom end of the tube 46 is open and is always disposed in recess 44. Tube 46 is slidable vertically in the recess.

Tube 46 has a second constriction 48 disposed in its hollow interior intermediate its ends. This second constriction has an inwardly and downwardly extending wall with a central opening.

A vertical cylinder like prong having a small lower end 50, an enlarged upper end 52 larger in diameter than the opening in constriction 48 and a main cylindrical body 54 is disposed in the interior of tube 46 and in bore 40.

Small lower end 50 of the prong is disposed in the first constriction and snap fitted therein, the ribs 42 engaging an outer circular groove in end 50. The main body 54 is slidable in the second constriction 48 with sufficient clearance that liquid can flow around the body and through the second constriction. The spaced ribs in the first constriction always permit liquid to flow therethrough even with end 50 in position.

The tube 46 has a normal raised position when the diaphragm is not flexed (see FIG. 2) whereby end 52 engages the second constriction 48 in sealing engagement thus forming a closed valve which prevents liquid passage. Any internal increase in air pressure will tend to force the end 52 and second constriction into even tighter engagement.

When the diaphragm is flexed and tube 46 depressed (see FIG. 3), the tube moves downward in recess 44 whereby the second constriction 48 is moved downwardly out of sealing engagement with end 52, thereby opening the valve and permitting liquid to pass therethrough.

All of the parts used herein can be plastic or other suitable material.

The invention can then be used as previously described.

What is claimed is:

1. A dispenser for use with a container of liquid having a vertical neck open at the top, said dispenser comprising:

a horizontal flexible diaphragm having a downwardly exending peripheral lip adapted for detachable sealing engagement with the periphery of the open neck whereby the diaphragm covers the neck opening, said diaphragm having a top disposed concave cup-like recess inwardly spaced from said lip centrally disposed therein with a central hole at the bottom thereof;

a vertically elongated hollow tubular element having an outwardly flared upper section disposed adjacent but spaced below the diaphragm and adapted for detachable sealing engagement with the periphery of said lip, said section having a side wall which defines an inverted truncated cone with spaced longitudinally extending slots therein, said element having a lower vertical hollow section with an upper opening coincident with the lower end of said cone and a lower opening adapted to extend into the container below the level of the liquid, the element also having a vertical bore extending therethrough, said bore having a first constriction which permits the passage of liquid therethrough disposed in the lower section adjacent but below the upper opening thereof, the bore wall containing a vertical cylindrical recess (spaced outwardly from the interior of the bore and spaced inwardly from the outer surface of the lower element) which communicates at its top end with the interior of the cone and has a closed bottom end disposed below said first constriction;

a vertically elongated hollow tube sealed to and extending through said hole has an open top end disposed above said hole in the concave recess and an open bottom end always disposed in the vertical recess, said tube being vertically slidable in said vertical recess, said tube having in its hollow interior a second constriction disposed intermediate the ends thereof, said top tube end having a plurality of horizontal spaced conduits interconnecting the interior of the tube with the interior of said concave recess; and a vertical prong disposed in said bore and the tube interior, the bottom end of the prong being secured in said first constriction without obstructing liquid passage therethrough, the top end of the prong being disposed above and larger than the second constriction, the main body of said prong being slidable through said second constriction with sufficient clearance to permit liquid to flow around said body through said second constriction, said tube having a normal raised position at which the second constriction and said top end are in sealing engagement and define a closed valve through which said liquid cannot pass, said tube having a momentarily lowered position at which said top end is spaced above the second constriction to open said valve and permit passage of said liquid therethrough.

2. The dispenser of claim 1 wherein said first constriction includes spaced vertical ribs extending radially inward from the interior surface of the bore to engage the bottom end of the prong.

3. The dispenser of claim 2 wherein said ribs engage an outer circular recess in said bottom end of the prong.

4. The dispenser of claim 2 wherein said second constriction extends downwardly and inwardly from the interior surface of the tube and has a central opening larger than the main body of the prong and smaller than the top end of the prong.

5. The dispenser of claim 4 wherein the main body of the prong is a cylinder.

6. The dispenser of claim 3 wherein said diaphragm has a circular groove in its top surface adjacent the peripheral lip.

* * * * *